US005287822A

United States Patent [19]

Anderson

[11] Patent Number: 5,287,822

[45] Date of Patent: Feb. 22, 1994

[54] PORTABLE WARNING MARKER

[76] Inventor: Roger K. Anderson, 415 Ridley St., Corydon, Ind. 47112

[21] Appl. No.: 992,552

[22] Filed: Dec. 18, 1992

[51] Int. Cl.[5] ..... E01F 9/00

[52] U.S. Cl. ..... 116/63 P; 116/63 C

[58] Field of Search ..... 116/63 P, 63 C, 63 T; 40/610, 612

[56] References Cited

U.S. PATENT DOCUMENTS

| | | | |
|---|---|---|---|
| 2,483,734 | 10/1949 | Neal | 40/612 |
| 2,762,328 | 9/1956 | Weig | 116/63 C |
| 2,942,571 | 6/1960 | White | 116/63 C |
| 3,192,889 | 7/1965 | Crudgington | 116/63 C |
| 3,496,904 | 2/1970 | Rimkus | 116/63 C |
| 3,707,320 | 12/1972 | Brynes | 116/63 C |
| 4,925,334 | 5/1990 | Beard | 116/63 C |
| 5,036,791 | 8/1991 | Thurston | 116/63 C |

FOREIGN PATENT DOCUMENTS

| | | | |
|---|---|---|---|
| 2627615 | 8/1989 | France | 116/63 T |
| 506697 | 12/1954 | Italy | 116/63 P |
| 1210909 | 11/1970 | United Kingdom | 116/63 C |

*Primary Examiner*—William A. Cuchlinski, Jr.
*Assistant Examiner*—W. Morris Worth
*Attorney, Agent, or Firm*—Maurice L. Miller, Jr.

[57] ABSTRACT

An improved portable warning marker of the type used to divert and/or guide motor vehicle traffic through or around roadway construction sites is disclosed. The warning marker may be of a foldable type including a plate member is pivotally attached to a flat base member, and a pair of wing members pivotally attached on opposite sides of the plate member so as to be independently tiltable from operative positions perpendicular to the plate and base members to a storage position against opposite broad surfaces of the plate member. Upon placing the wing members in their storage positions, the plate member is tiltable from an operative upright position to a downfolded storage position essentially parallel to the base member. A device for permitting a portable marker to be lifted through the use of a long handled tool having a hooked or forked end, which device is attached to an upper end of the marker is also disclosed. A transparent plastic cover for the viewable surface(s) of a portable warning marker for protecting the surface(s) from becoming dulled by oil, grease, tar and other impurities is also disclosed. A replaceable, non-transparent, brightly colored cover is disclosed for use on portable traffic markers which have already become dulled through prior use in order to permit their continued use is also disclosed.

20 Claims, 4 Drawing Sheets

FIG. 1
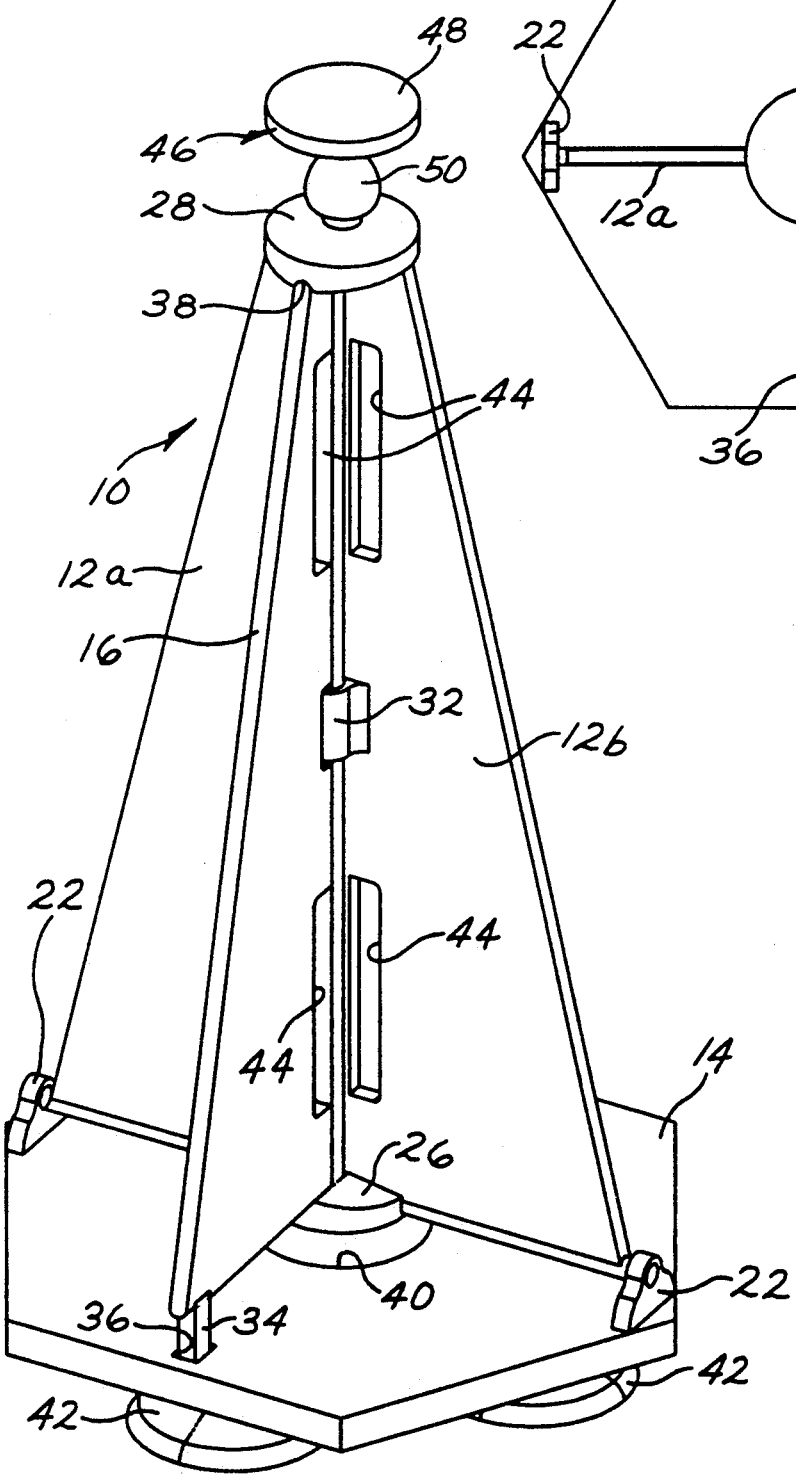
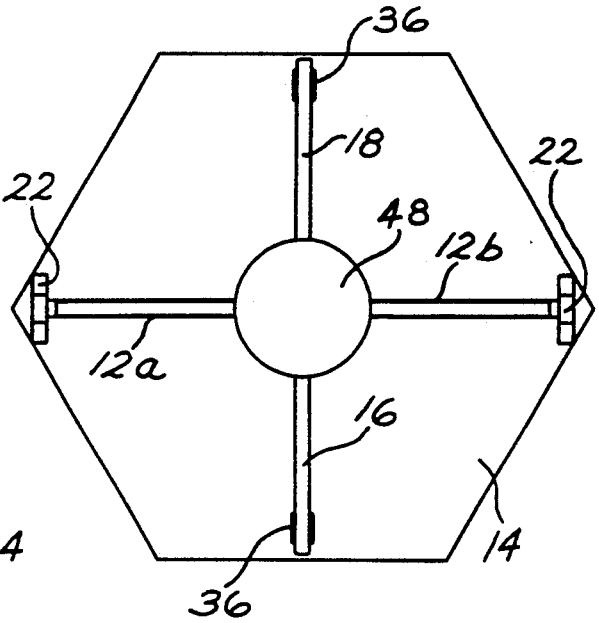
FIG. 2

48
46
50
10
52
28
18
38
30
24
12
44
31
32
34
44
24
44
16
20
30
26
38
44
22
36
14
40
34
36
22
42
42

PORTABLE WARNING MARKER

BACKGROUND OF THE INVENTION

This invention relates generally to improvements in portable warning markers of the type used to divert motor vehicle traffic through and/or around construction sites, areas where painting and/or clean up work is in progress and the like.

Portable warning markers, particularly those of the plastic cone shaped type, have long been known and used in the prior art. Because of their shape, such cone shaped markers, take up a great deal of space during transport and storage, even when stacked one upon the other in groups of six or eight markers per stack. For this reason, there have been a number of attempts made to render cone shaped markers collapsible and foldable as a space saving measure in the storage and transport thereof. See, for example, U.S. Pat. No. 4,466,376 issued to H. D. Wells on Aug. 21, 1984; U.S. Pat. No. 4,256,050 issued to B. G. Barnard on Mar. 17, 1981; U.S. Pat. No. 2,954,005 issued to L. A. Cioffi, et al. on Sep. 27, 1960; and U.S. No. 2,762,327 issued to M. O. Weig on Sep. 11, 1956.

The Wells patent discloses a fan shaped panel of cardboard stock having four triangular faces joined together along adjacent sides by fold lines. The fan shaped panel is formed into a four sided polygon or pyramid, the base of which is attached to a base panel which has portions foldable to form a rectangular wall around the base of the pyramid. While the reference structure is, indeed, foldable, it is foldable only to assemble the structure, not to disassemble it for transport and storage purposes. The cardboard stock from which the marker is made is not very resistant to wet weather, and the base and pyramid components must be disassembled in order to unfold the unit for storage, thus resulting in two distinct broad, flat panels.

The Baker patent discloses a collapsible cone formed from a continuously extended plastic strip wound in a roll upon a base plate. A central handle permits lifting of the inner most turn of the roll which, in turn, lifts successive turns until the strip forms a vertically extending cone shaped helix. Spaced apart projections along the strip prevent the innermost turn from being pulled up so far from the base that successive turns of the helix separate from one another.

An earlier version of a collapsible traffic cone is shown in the Cioffi et al. patent wherein separate cone shaped rings of varying diameter which fit within one another can be pulled up from a relatively flat package to form a cone shaped marker.

The patent to Weig discloses an inflatable cone shaped marker that can be deflated to form a flat package for storage and transport purposes. But this device is dependent upon the integrity of its air valve which is used to inflate and deflate the device, which could be susceptible to slow air leakage over the many months of time that such devices are often used on a highway construction job site. Also, puncture of the casing of this device, as by means of flying gravel, glass or other projectiles caused by passing traffic is a constant threat to its integrity.

Moreover, none of these collapsible, foldable or inflatable markers is adapted for pick-up from a job site for placement on a truck by means of a suitable long handled tool operated by a worker from the truck bed. These prior art devices require that a worker walk along beside a truck, pick up each marker by hand, and either place it onto the truck bed himself, or hand it to another worker stationed on the truck bed. It would be advantageous if such devices were adapted for pick up by a worker stationed on the truck bed using a suitable long handled tool having a single hooked or forked end.

Another difficulty encountered with prior art portable traffic markers is the fact that their bright colored reflective surfaces tend to become dulled by oil, grease, tar and other impurities which build up thereon over a period of time when exposed to motor vehicle traffic and construction around highway job sites where such markers are routinely employed. Many state highway departments, such as in my state of Kentucky, for example, require such dulled markers to be retired from service when their bright surfaces reach a certain level of dullness and/or lack of reflectivity. It has been my experience that the conventional plastic cone shaped markers used around highway construction projects often have a useful in-service life of no more than about six months, and sometimes even less. These markers are relatively expensive to replace so often, especially when used in great volumes over long stretches of interstate highway, often extending for many miles as, for example, between successive access ramps which are often spaced many miles apart in rural areas.

By means of my invention, these and other difficulties encountered when using portable warning markers of the prior art are substantially overcome.

SUMMARY OF THE INVENTION

It is an object of my invention to provide a novel foldable portable warning marker.

It is another object of my invention to provide a novel foldable portable warning marker which has the appearance at a distance similar to the usual prior art plastic cone shaped marker whose shape is highly familiar to present day motorists.

It is yet another object of my invention to provide a portable warning marker having means by which it can be lifted by a person using a simple long handled tool while located on the load bed of a moving truck.

It is a further object of my invention to provide a transparent cover to protect the color and reflectivity of the viewable surface of a portable warning marker.

It is also an object of my invention to provide a readily replaceable non-transparent, bright colored cover for a portable warning marker which will extend the useful life of the latter.

Briefly, in accordance with my invention, there is provided a portable warning marker which includes a base member having a broad, flat upper surface, and a relatively flat plate member pivotally attached to the upper surface so as to be tiltable between an operative upright position and a downfolded storage position essentially parallel to the upper surface. A pair of relatively flat wing members are also provided which are pivotally attached to said plate member so that each wing member is tiltable between an operative position perpendicular to said plate member and folded storage position against a different one of the broad sides of the plate member. Means is also provided for releasably securing the wing members to the base member when the wing and plate members are in their operative positions.

These and other objects, features and advantages of my invention will become apparent to those skilled in the art from the following detailed description and attached drawings upon which, by way of example, only the preferred embodiments of my invention are described and illustrated.

BRIEF DESCRIPTION OF THE DRAWINGS

FIG. 1 shows a perspective view of a foldable warning marker assembly when in its unfolded, operative condition, thus illustrating one preferred embodiment of my invention.

FIG. 2 shows a top plan view of the marker assembly of FIG. 1.

DESCRIPTION OF THE PREFERRED EMBODIMENTS

Figure 3:
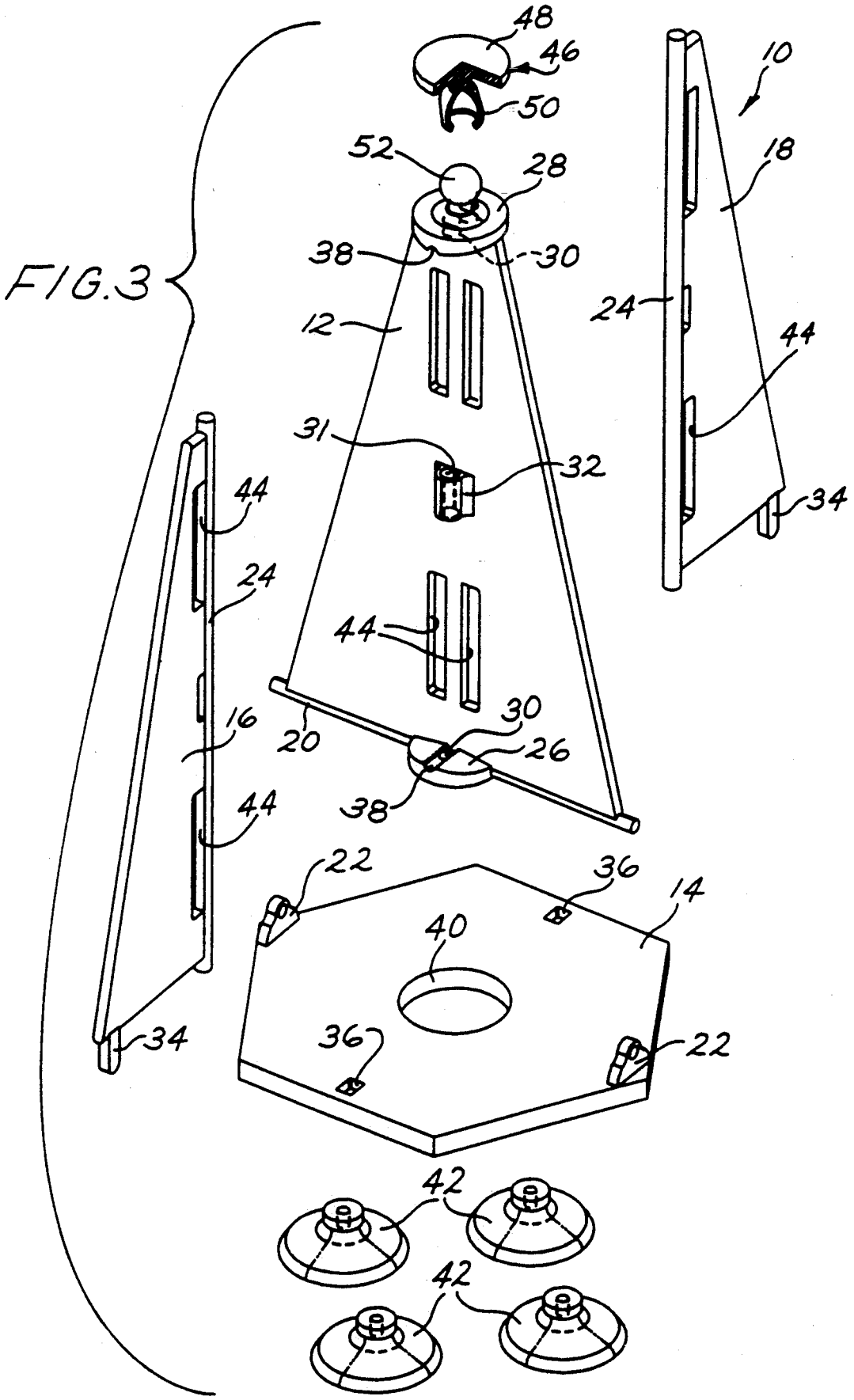
FIG. 3 shows an exploded perspective view of the marker assembly of FIGS. 1-2.

Referring now to the drawing figures and, specifically, to FIGS. 1-5, there is shown, in a preferred embodiment of my invention, a foldable warning marker, generally designated 10. The marker 10 includes a relatively flat plate member 12, generally in the shape of an isosceles triangle (See particularly FIG. 3), which is pivotally attached along its base to a relatively broad, flat base plate 14. Also included is a pair of relatively flat wing members 16, 18 which are tiltable, independently of one another relative to the plate member 12. The wing members 16, 18 are each generally in the shape of a right triangle and are sized so that the assembly 10 appears to have four identical right triangularly shaped wings 12*a*, 12*b* (See FIGS. 1-2 and 4-5 wherein wings 12*a* and 12*b* are actually portions of the plate generally designated 12 in FIG. 3), 16 and 18 which are rotationally displaced ninety degrees apart from adjacent ones thereof, along a vertical axis of the assembly 10 when the latter is in its operative condition at best seen in FIGS. 2-3. As such, the assembly 10, when in its operative condition, simulates a conventional cone shaped warning marker of the type often seen near construction sites along the roadways of this country. This simulation is deemed advantageous since the highway traveling public is, for the most part, very familiar with conventional cone shaped markers.

Figure 4:
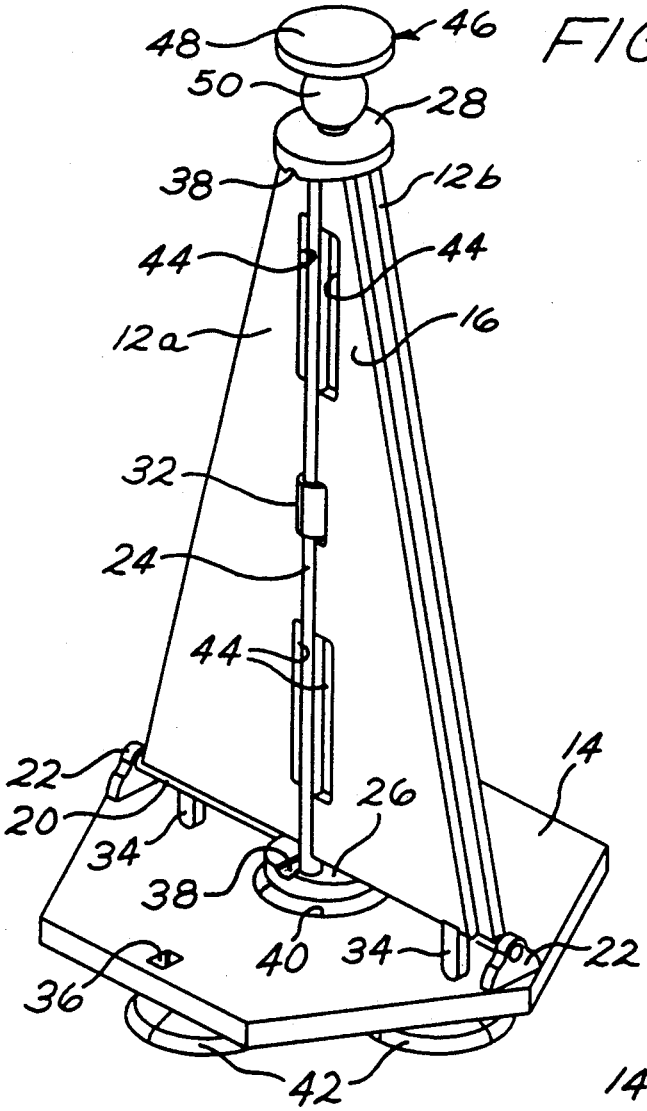
FIG. 4 shows a perspective view of the marker assembly of FIGS. 1-3 in a partially folded condition.
Figure 5:
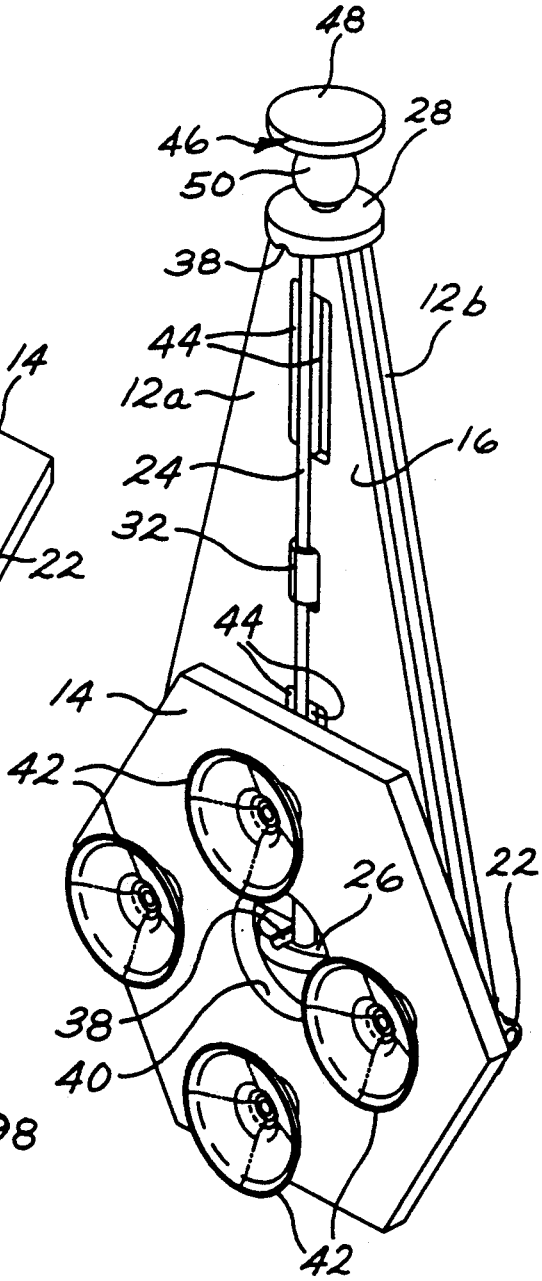
FIG. 5 shows a perspective view of the marker assembly of FIGS. 1-4 in a fully folded condition.

One advantage of my marker over the conventional cone shaped marker is that my marker 10 is foldable into a relatively flat package for convenient shipping and storage purposes in the manner as shown in FIGS. 4-5. To illustrate this important feature, note first that the plate 12 is attached along its base edge to an elongated rod 20, opposing end portions of which project outwardly beyond the base edge and which are journaled in a pair of bearing blocks 22 affixed to opposite sides of the upper surface of the base plate 14. Each of the wing members 16, 18 have an elongated rod 24 affixed to a vertical edge thereof. The rod 24 of the wing member 16, for example, extends vertically between a semi-cylindrically shaped cam block 26 attached to a central side portion of the rod 20 and a corresponding side of a cylindrically shaped cam block 28 affixed to an upper edge of the plate member 12. End portions of the rod 24 of the wing member 16 are journaled in apertures 30 (See FIG. 3) formed in opposing surface portions of the blocks 26 and 28 immediately next to the plate 12 and rod 20. A central portion of the rod 24 snap fits into a cylindrical channel 31 in a bracket 32 attached to a central portion of the plate 12, whereby the subject rod 24 is pivotal, horizontally, about its longitudinal axis with its end portions being journaled in the apertures 30 and its central portion being slidably disposed, both vertically and rotationally, in the bracket 32. The rod 24 of the wing member 18 is pivotally attached on the opposite side of the plate 12 from the rod 24 of the wing member 16 in the same manner as the rod 24 of the wing member 16.

The wing members 16 and 18 are thus tiltable, independently of one another, between their operative positions as shown in FIGS. 1-3 and their folded positions lying against opposite faces of the plate member 12 as shown in FIG. 4. A tab 34 is attached on an outer bottom edge of each of the wing members 16 and 18 which projects downwardly into a detent 36 in an upper surface portion of the base plate 14 when each of the wing members 16 and 18 is disposed in its operative position as shown in FIGS. 1-2. The detents 36 need be just deep enough to positively fix the wing members 16 and 18 in their operative positions. In the present example, each of the members 16 and 18 can be lifted by hand against the cam block 28 to produce a slight bowing or bending of the rods 24 and corresponding wing members 16 and 18 so as to permit removal of a tab 34 from its corresponding detent 36, preparatory to pivoting one or both of the wing members 16, 18 against the plate 12. The upper surface of the cam block 26 and the lower surface of the cam block 28 each contain a groove 38 in which lower and upper edges, respectively, of the wing members 16 and 18 rest to further fix the wing members in their operative positions.

The wing members 16 and 18 should be in a slightly vertically compressed state in the opposing grooves 38 of the blocks 26 and 28 when in their operative positions as shown in FIGS. 1-2. Then, when the tab 34 of either one of the wing members 16 or 18 is lifted out of its corresponding detent, thus slightly bowing the wing member, preparatory to folding the same against the plate 12, the opposing cam surfaces of the blocks 26 and 28 will facilitate the folding action. That is because, as a given wing member 16, 18 is pivoted toward its storage position flush against the plate 12, the diagonally cammed surfaces of the blocks 26 and 28 continuously relieve the compression force on the subject wing member as it is so pivoted. And because these cam surfaces present the least compression force against the wing members 16, 18 when the latter are placed in their storage positions, the cam surfaces tend to urge the folded wing members 16, 18 to remain in their folded states. In other words, the cam surfaces of the blocks 26 and 28 tend to maintain the members 16, 18 in their folded states against the plate 12 when the wing members 16, 18 are placed in that condition.

The semi-cylindrical cam blocks 26 attached to opposite central side portions of the rod 20, form a generally circularly shaped outer edge between the two of them. A somewhat larger diameter circular opening 40 is formed in the base plate 14, directly above which, the two semi-cylindrically shaped portions of the cam block 26 are disposed when the plate 12 is operatively upright relative to the base plate 14 as shown in FIG. 1. The circular opening 40 thus permits one or the other of the semi-cylindrical portions of the cam block 26 to tilt downwardly therein as the plate 12 is tilted one way or the other from its operative position toward its storage position against the base plate 14. Without the opening 40, one or the other of the other portions of the block 26 would tilt into and bind against the base plate 14 as the plate member 12 is tilted, thus preventing the plate member 12 from being folded fully flush against the base plate 14.

It will be appreciated that the same arrangement of foldable wings and plate as illustrated in the present example, may be used to form a simulated barrel type warning marker assembly. In such an arrangement, the plate and wings will be of rectangular shape to simulate a barrel marker rather than of triangular shapes as shown in FIGS. 1-5. Otherwise, the construction and operation of such a simulated foldable barrel assembly will be the same as previously described.

I recommend the use of four flexible suction cups 42 which may be attached to the underside of the base plate 14 as shown, although this is not essential. The cups 42 may be connected in any suitable manner as, for example, by means of conventional threaded fasteners. This will inhibit, to at least some extent, the tendency of the base plate 14 to slide as the result of wind blowing against the plate and wing members 12, 16 and 18 when the base plate 14 stands on a wet or otherwise slippery pavement. Slots 44 are formed in the plate and wing members 12, 16 and 18 near their mutual intersections to allow air to pass through to help prevent wind from blowing the assembly 10 over or out of its intended position.

Another feature of the present example of my invention is a pick-up element generally designated 46 which is attached to the upper cam block 28. The element 46 includes a disc shaped cap 48 attached on one broad surface to a ball housing 50. The bottom end of the housing 50 is open so as to snap fit over a ball bearings 52 which is mounted on top of the cam block 28 (See particularly FIG. 3). The element 46 allows pickup of the assembly 10 by means of a long handled tool having a forked end whose two tines are adapted to fit on opposite sides of the ball housing 50 under the cap 48. Thus, when pick up of a long string of such devices from a road way is required, a worker located in the load bay of a pickup truck or the like can use such a tool to pick up one after another in a series of warning markers such as the marker 10 and swing them over onto the truck load bed without the necessity of leaving the truck. The time and effort saved by not having to repeatedly leave and return to the truck or by not having to walk along side the truck to manually pick up each of a series of markers and place them on the truck bed or hand them to other workers on the truck bed will be substantial. The pick-up element 46 shown in FIGS. 1-5 of the present example, can also be advantageously employed on the upper end of a conventional cone shaped marker as well as on other types of portable markers.

Figure 8:
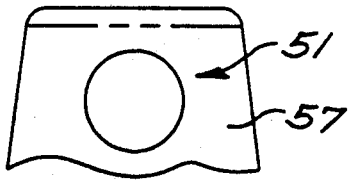
FIG. 8-11 show fragments of upper end portions of otherwise conventional cone shaped warning markers, each of which portions include a different means for permitting the corresponding marker to be picked up with a long handled tool having a forked end.
Figure 10:
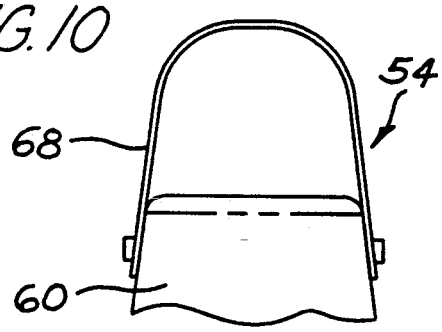
Figure 9:
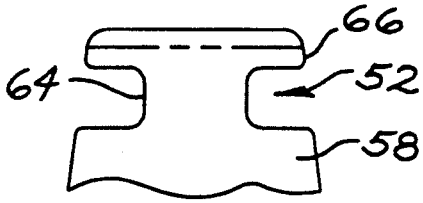
Figure 11:
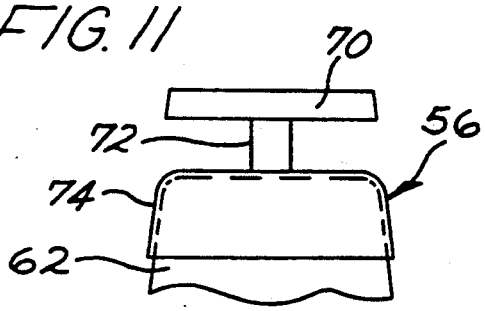

Referring now to FIGS. 8-11, there is shown four additional examples of pick-up elements 51, 52, 54 and 56 for use with portable warning markers. These devices are shown, for illustrative purposes, as being attached to or formed on the upper end portions of four conventional cone shaped markers 57, 58, 60 and 62, respectively. In FIG. 8 the pick-up element 51 comprises an aperture formed through an upper end portion of an otherwise conventional cone shaped marker 57. Thus a long handled tool with a hooked end can be used to pick up the marker 57 by inserting the hooked end through the aperture 51. In FIG. 9, an annular groove 64 is formed around an upper end portion of a marker 58. The groove 64 thus defines a generally disc shaped cap 66 above it. The tines of a forked tool can thus be inserted into opposite sides of the groove 64 from any direction to bear upwardly against the underside of the cap 66 to lift the marker 58. In FIG. 10, a strap loop 68 is attached on opposite ends thereof to opposite sides of an upper end portion of a cone shaped marker 60. A long handled tool containing a hook or the tines of a fork on one end can be used to lift the marker 60 by lifting the strap 68. In FIG. 11, the pick-up element 56 includes a disc shaped cap 70 attached to a post 72 which is, in turn, connected to an inverted cup 74. The cup 74 is sized to fit on and around an upper truncated end portion of a cone shaped marker 62 in relatively close fitting relationship so that it may be glued in place as shown. Pick up of the marker 62 by means of the pick up element 56 can be accomplished in the same manner as with the pick-up element 66 of FIGS. 1-5 and as with the groove 64 and cap 66 of the marker 52 shown in FIG. 9.

Figure 6:
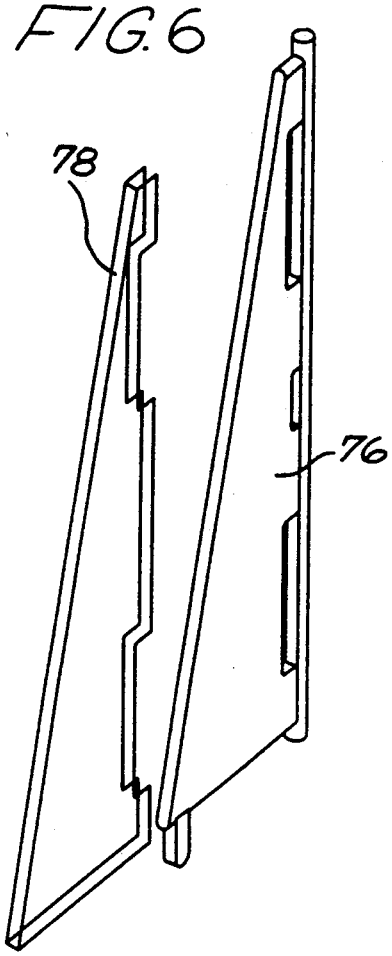
FIG. 6 shows an exploded perspective view of a portion of the marker assembly of FIGS. 1-5 and a transparent protective cover for such portion.

Another important feature of my invention is a transparent plastic cover to protect the viewing surfaces of portable warning markers from becoming covered with grease, road grime, oil, rock dust, road dust and the like. Referring to FIG. 6, there is shown a wing member 76 of the same type as used in the assembly 10 of FIGS. 1-5. A transparent plastic cover 78 of closely conforming size and shape may be slipped over the member 76 to cover its viewable surfaces and protect them from becoming dulled by dirt, grime, oil, grease, tar and the like. In this way, four such covers 78 can be used to cover the viewing surfaces of the plate and wing members 12, 16 and 18 of the assembly 10 of FIGS. 1-5.

Figure 7:
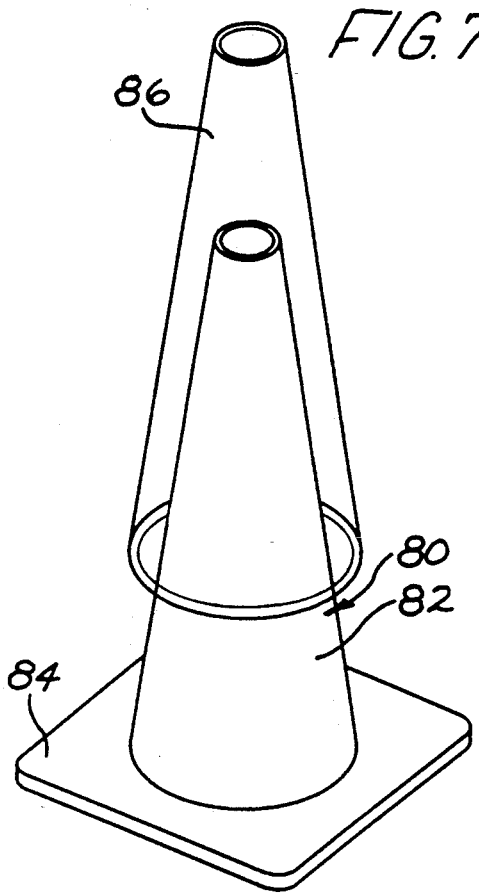
FIG. 7 shows an exploded perspective view of a conventional cone shaped warning marker and a transparent cone shaped protective cover for protecting the viewable surface of such marker.

Referring now to FIG. 7, a conventional plastic traffic cone 80 of well known type is shown which includes a truncated cone 82 forming a warning surface and a base 84. A similarly sized cone shaped transparent plastic cover 86 is applied over the top of the cone 80 to protect its viewing surface from becoming dulled by grease, oil, tar, rock dust, road dust and the like. Note that the cone shaped cover 86 can also be used to protect the viewing surfaces of the foldable marker assembly 10 of FIGS. 1-5, as a substitute for the four covers 78 of FIG. 6.

By using relatively inexpensive transparent protective covers such as cover 78 of FIG. 6, the cone shaped cover of FIG. 7 and the like, relatively more expensive warning markers will have their useful life extended indefinitely. These relatively less expensive covers can be readily removed from their markers when they become dulled by contaminates and can be replaced with new ones, thus avoiding the rapid rate of replacement of portable markers that has previously been necessary in order to meet various state highway department safety standards which require a high level of brightness of their viewable surfaces.

Alternatively, the covers of FIGS. 6–7 can be constructed of a bright colored non-transparent plastic for use with markers which have otherwise become too dull and dirty for further use due to past service in contaminated environments. Such alternative covers may, for example, be constructed to have the same familiar bright orange appearance that state highway department regulations often require for warning markers themselves. In this way, used warning markers destined for retirement from service can be saved and reused indefinitely.

With reference to my foldable warning marker 10 as exemplified in FIGS. 1–5, it will be appreciated that its various component parts, as for example, the plate 12 and wings 16 and 18 are interchangeable with corresponding component parts of other similar markers. Thus, where a foldable marker is damaged, those of its component parts which are not damaged can be reused as replacement parts for other damaged markers. Where such a marker receives damage to certain of its components, but not all of them, only the damaged components need be replaced, thus avoiding the need to discard the entire assembly and purchase a new one to replace it as is ordinarily necessary when a prior art warning marker such as the cone 80 of FIG. 7 is damaged.

Figure 12:
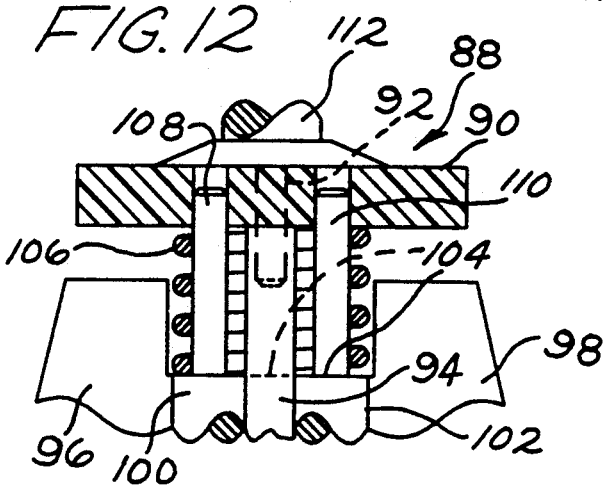
FIG. 12 shows a side elevation view of an alternative upper portion for a foldable warning marker which is otherwise of the type shown in FIGS. 1-5.

Referring now to FIG. 12, an alternative arrangement for the upper end portion 88 of the foldable warning marker of my invention is shown. A circular disc 90 is fixedly connected by a pin 92 to the upper end of a plate 94. A pair of foldable wings 96 and 98 are attached to elongated rods 100 and 102, respectively, which rods are, in turn, rotatably attached to the plate 94. The plate 94 and wings 96, 98 contain slots in the upper central surfaces thereof which form a recess 104 in which a coiled spring 106 is disposed. A pair of pins 108 and 110 extend out of the upper ends of the rods 100 and 102 up through the spring 106 and slots in the disc 90 to retain the spring 106 in the recess 104. The plate 94 and wings 96 and 98 thus connect together and function in the same manner as the wings 12*a* and 12*b* and plate 16 of the example shown in FIGS. 1–5. The plate 94 is tiltably mounted on a base in the same manner as the corresponding components shown in those figures. Finally, a cap similar to the cap 48 of FIGS. 1–5 or other liftable element may be attached, as at 112, to the disc 90.

Now, instead of having to lift the wings 96 and 98 against the underside of a cam surface in order to cause a slight bowing of the wings, preparatory to folding them against the plate 94 in the manner as required in the example of FIGS. 1–5, the wings 96 and 98 can simply be lifted to compress the spring 106 until they are sufficiently clear of their base so as to be folded. Otherwise, when the plate 94 and wings 96 and 98 of the present example are disposed in their operative positions as shown, the spring 106 is in a slightly compressed state so as to cause the wings 96 and 98 to bear down upon their base to maintain those wings in their operative positions as, for example, by causing tabs on the outward lower edges to bear down into slots in their base, the same as the tabs 34 and slots 36 of the previous example as best shown in FIGS. 1–2.

Although the present invention has been described and shown with respect to specific details of certain preferred embodiments thereof, it is not intended that such details limit the scope of this patent other than as specifically set forth in the following claims.

I claim:

1. A foldable marker comprising a base member having a relatively broad, flat upper surface, a relatively flat plate member attached to said upper surface, means for pivoting said plate member relative to said upper surface such that said plate member is tiltable between an operative upright position perpendicular to said upper surface and a downfolded storage position essentially parallel to said upper surface, a pair of relatively flat wing members attached on opposite broad sides of said plate member, means for pivoting each of said wing members relative to said plate member between an operative position perpendicular to said plate member and a folded storage position against a different one of said broad sides, said wing members being aligned with one another in essentially the same plane when both are in their operative positions, and means for releasably securing said wing members to said base member when said wing and plate members are disposed in their operative positions to maintain said wing and plate members in said operative positions.

2. The marker of claim 1 wherein said wing members intersect said plate member at right angles along essentially a single vertical line of intersection when said members are in their respective operative positions to form four essentially identical walls extending radially outwardly from said line.

3. The marker of claim 1 wherein said plate member forms an isosceles triangle and said wing members each form a right triangle.

4. The marker of claim 1 further comprising means attached to an upper end of said plate member for being lifted with a tool to permit lifting said marker by lifting said tool while said plate and wing members are disposed in their respective operative positions.

5. The marker of claim 1 wherein said plate and wing members define openings therein through which air may pass for reducing the resistance of said members to wind.

6. The marker of claim 1 wherein said plate member pivoting means comprises a rod fixedly attached to and extending along a base edge of said plate member, opposite end portions of which rod project beyond side edges of said member, and a pair of spaced apart and aligned bearing blocks attached to said upper surface, opposite projecting end portions of said rod being pivotally journaled in said blocks.

7. The marker of claim 1 wherein said securing means comprises a pair of spaced apart upwardly opening detents formed in an upper surface portion of said base member, a pair of tabs attached to outer base edge portions of said wing members, each of said tabs being aligned for insertion into a different one of said detents when said plate member and corresponding one of said wing members are disposed in their respective operative positions, each of said wing members being slidable along said plate member for a distance which is at least approximately equal to the depth of a corresponding one of said detents, and spring biasing means disposed between said plate member and said wing members for urging said tabs into said detents when said plate and wing members are disposed in their respective operative positions, said wing members being manually liftable in opposition to said biasing means to lift said tabs out of said detents preparatory to tilting said wing members toward their folded storage positions against said plate member.

8. The marker of claim 2 wherein said plate member forms an isosceles triangle and said wing members each form a right triangle, wherein said members simulate a cone shaped warning marker when disposed in their operative positions.

9. The marker of claim 2 wherein said plate and wing members each form a rectangle, wherein said members simulate a barrel shaped warning marker when disposed in their operative positions.

10. The marker of claim 4 wherein said lifting means comprises a ball member secured to an upper end of said plate member, and a cap including a socket depending therefrom, said ball member being slidably disposed in said socket to from a ball and socket joint between said member and cap, said cap and socket being adapted for confining the tines of a forked tool inserted therebetween to permit the lifting of said marker by lifting said tool.

11. The marker of claim 4 wherein said lifting means comprises a ring attached to an upper end of said plate member adapted for insertion of an elongated tool therein to permit lifting of said marker by lifting said tool.

12. The marker of claim 1 further comprising transparent means for removably covering the broad surfaces of said plate and wing members for protecting said surfaces from becoming dulled by contamination such as tar, grease, oil and other substances.

13. The marker of claim 1 further comprising non-transparent means for removably covering the broad surfaced of said plate and wing members for permitting the continued use of said marker after its viewable surfaces have become dulled by use in a contaminated environment.

14. The marker of claim 7 wherein said wing members pivoting means comprises an elongated pivot rod attached to and extending along an edge of each of said wing members next to said plate member, opposite end portions of said pivot rod projecting beyond opposite ends of its corresponding one of said wing members, and a pair of rod bearing members attached to opposite ends of said plate member, the projecting end portions of said pivot rod, in each instance, being pivotally journaled in said bearing members, said spring biasing means being confined between an upper one of said bearing members and an upper end of both of said wing members for urging said wing members downwardly relative to said plate member, said bearing members each defining a elongated groove therein for confining a lower edge of a different one of said wing members therein when said wing and plate members are disposed in their respective operative positions, opposing surfaces of said bearing members being inclined on opposite sides of their respective grooves such that said wing members are urged by said spring biasing means along said inclined surfaces toward their folded storage positions against said plate member when the lower edge portions of said wing members are rotated out of their corresponding bearing member grooves.

15. In an improved marker of the type which conventionally includes a cone shaped body having a circular base and an upper apex, and a relatively broad base upon which the base of said cone shaped body is mounted, the improvement of which comprises means attached to an upper end of said body for providing a surface under which a tool can be disposed to permit the lifting of said marker by lifting said tool, said lifting surface providing means comprising a flat cap including a ball shaped socket attached to a broad surface thereof, and a ball member attached to the upper end of said body, said socket being adapted to closely fit over and around said ball member.

16. The marker of claim 1 wherein said wing members pivoting means comprises an elongated pivot rod attached to and extending along an edge of each of said wing members next to said plate member, opposite end portions of said pivot rod projecting beyond opposite ends of its corresponding one of said wing members, a pair of rod bearing members attached to opposite ends of said plate member, the projecting end portions of said pivot rod, in each instance, being pivotally journaled in said bearing members, and a pair of brackets attached to opposite broad surfaces of said plate member and aligned with a different said pivot rod, each of said brackets defining a cylindrically shaped, vertically extending channel therein, each of said pivot rods being snap fittable into a different one of said brackets for both rotatable and slidable disposition therein.

17. The marker of claim 1 further comprising means for covering viewable surfaces of said wing plate and wing members for protecting said surfaces from contamination.

18. The marker of claim 16 wherein said covering means comprises a single transparent cover.

19. The marker of claim 16 wherein said covering means comprises a single brightly colored non-transparent cover.

20. The marker of claim 16 wherein said covering means comprises at least one removable cover.

* * * * *